US010007229B2

(12) United States Patent
Mochizuki et al.

(10) Patent No.: US 10,007,229 B2
(45) **Date of Patent: *Jun. 26, 2018**

(54) IMAGE FORMING APPARATUS THAT REDUCES REMAINING AMOUNT OF DEVELOPER DURING EXCHANGE OF DEVELOPER HOUSING PORTION AND METHOD OF RELEASING REGULATION ON ATTACHMENT/REMOVAL OF DEVELOPER HOUSING PORTION

(71) Applicant: KYOCERA Document Solutions Inc., Osaka (JP)

(72) Inventors: Masayuki Mochizuki, Osaka (JP); Tsuyoshi Terada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/484,854

(22) Filed: Apr. 11, 2017

(65) Prior Publication Data

US 2017/0315501 A1 Nov. 2, 2017

(30) Foreign Application Priority Data

Apr. 27, 2016 (JP) ..... 2016-089874

(51) Int. Cl.
*G03G 21/00* (2006.01)
*G03G 21/16* (2006.01)
(Continued)

(52) U.S. Cl.
CPC ..... *G03G 21/1676* (2013.01); *G03G 15/0856* (2013.01); *G03G 15/0865* (2013.01);
(Continued)

(58) Field of Classification Search
CPC ..... G03G 21/1676; G03G 15/0856; G03G 15/0865; G03G 15/50; G03G 15/5016; G03G 15/556
See application file for complete search history.

(56) References Cited

U.S. PATENT DOCUMENTS 5,508,795 A 4/1996 Kikuchi ..... 355/260
2013/0039668 A1 2/2013 Takahashi ..... 399/25
(Continued)

FOREIGN PATENT DOCUMENTS

JP 6-258941 A 9/1994

OTHER PUBLICATIONS

Extended European Search Report dated Sep. 25, 2017, issued by the European Patent Office in corresponding application EP 17168379.0.

*Primary Examiner* — David M Gray
*Assistant Examiner* — Michael Harrison
(74) *Attorney, Agent, or Firm* — Stein IP, LLC

(57) ABSTRACT

An image forming apparatus includes a mounting portion, a lock mechanism, an image forming unit, a first detection processing unit, a second detection processing unit, a first release processing unit, and a second release processing unit. The first detection processing unit detects a first state where a remaining amount of the developer is less than a predetermined first reference amount. The second detection processing unit detects a second state where the remaining amount of the developer is equal to or more than the first reference amount and less than a predetermined second reference amount. The second reference amount is larger than the first reference amount. The first release processing unit releases the regulation on the attachment/removal of the developer housing portion when the first state is detected. The second release processing unit releases the regulation
(Continued)

when unit the second state is detected and a predetermined release condition is met.

8 Claims, 10 Drawing Sheets

(51) Int. Cl.
*G03G 15/00* (2006.01)
*G03G 15/08* (2006.01)

(52) U.S. Cl.
CPC ..... *G03G 15/50* (2013.01); *G03G 15/5016* (2013.01); *G03G 15/556* (2013.01); *G03G 2215/0888* (2013.01); *G03G 2221/1654* (2013.01)

(56) References Cited

U.S. PATENT DOCUMENTS

| | | | | |
|---|---|---|---|---|
| 2016/0054680 | A1 | 2/2016 | Okuda | |
| 2017/0315470 | A1* | 11/2017 | Mochizuki ..... | G03G 15/0831 |
| 2017/0315502 | A1* | 11/2017 | Mochizuki ..... | G03G 21/1676 |

* cited by examiner

IMAGE FORMING APPARATUS THAT REDUCES REMAINING AMOUNT OF DEVELOPER DURING EXCHANGE OF DEVELOPER HOUSING PORTION AND METHOD OF RELEASING REGULATION ON ATTACHMENT/REMOVAL OF DEVELOPER HOUSING PORTION

INCORPORATION BY REFERENCE

This application is based upon, and claims the benefit of priority from, corresponding Japanese Patent Application No. 2016-089874 filed in the Japan Patent Office on Apr. 27, 2016, the entire contents of which are incorporated herein by reference.

BACKGROUND

Unless otherwise indicated herein, the description in this section is not prior art to the claims in this application and is not admitted to be prior art by inclusion in this section.

A developer housing portion such as a toner container, which houses developer such as toner used for printing, is mounted to a typical image forming apparatus such as a printer. With this type of image forming apparatus, a user exchanges the developer housing portion at any timing. Additionally, there has been known an image forming apparatus that includes a lock mechanism. To reduce a remaining amount of developer in a developer housing portion during exchange, the lock mechanism regulates attachment/removal of the developer housing portion until a detection of the developer housing portion running out of the developer.

SUMMARY

An image forming apparatus according to a one aspect of the disclosure includes a mounting portion, a lock mechanism, an image forming unit, a first detection processing unit, a second detection processing unit, a first release processing unit, and a second release processing unit. A developer housing portion to house developer is mounted to the mounting portion. The lock mechanism is configured to regulate attachment/removal of the developer housing portion mounted to the mounting portion. The image forming unit forms an image using the developer. The first detection processing unit detects a first state. The first state is a state where a remaining amount of the developer housed in the developer housing portion mounted to the mounting portion is less than a predetermined first reference amount. The second detection processing unit detects a second state. The second state is a state where the remaining amount of the developer housed in the developer housing portion mounted to the mounting portion is equal to or more than the first reference amount and less than a predetermined second reference amount. The second reference amount is larger than the first reference amount. The first release processing unit releases the regulation on the attachment/removal of the developer housing portion by the lock mechanism when the first detection processing unit detects the first state. The second release processing unit releases the regulation on the attachment/removal of the developer housing portion by the lock mechanism when the second detection processing unit detects the second state and a predetermined release condition is met.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
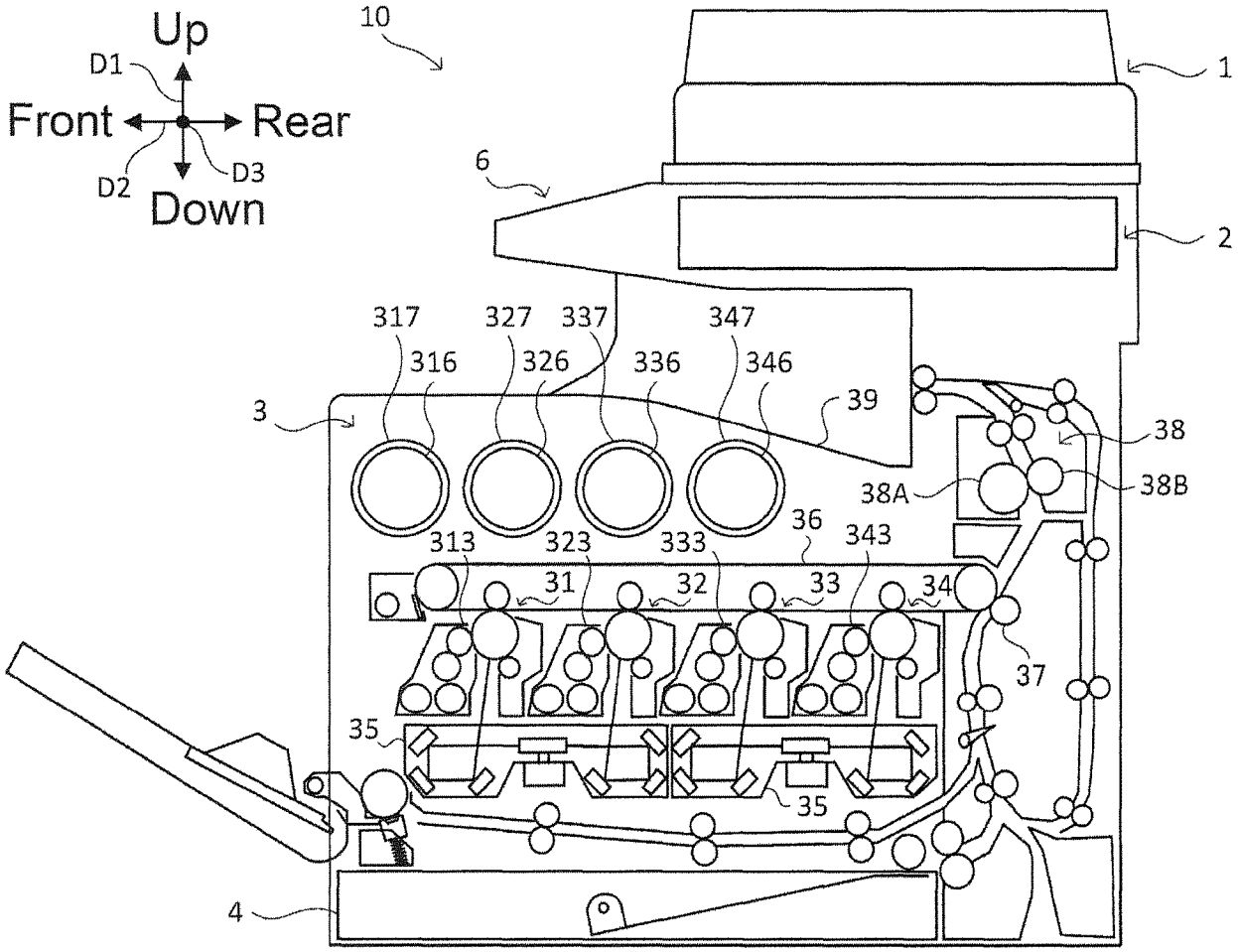
FIG. 1 illustrates a configuration of an image forming apparatus according to a first embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the attached drawings for understanding the disclosure. The following embodiments are merely exemplary embodiments according to the disclosure and do not intend to limit the technical scope of the disclosure.

Schematic Configuration of Image Forming Apparatus 10

Figure 2:
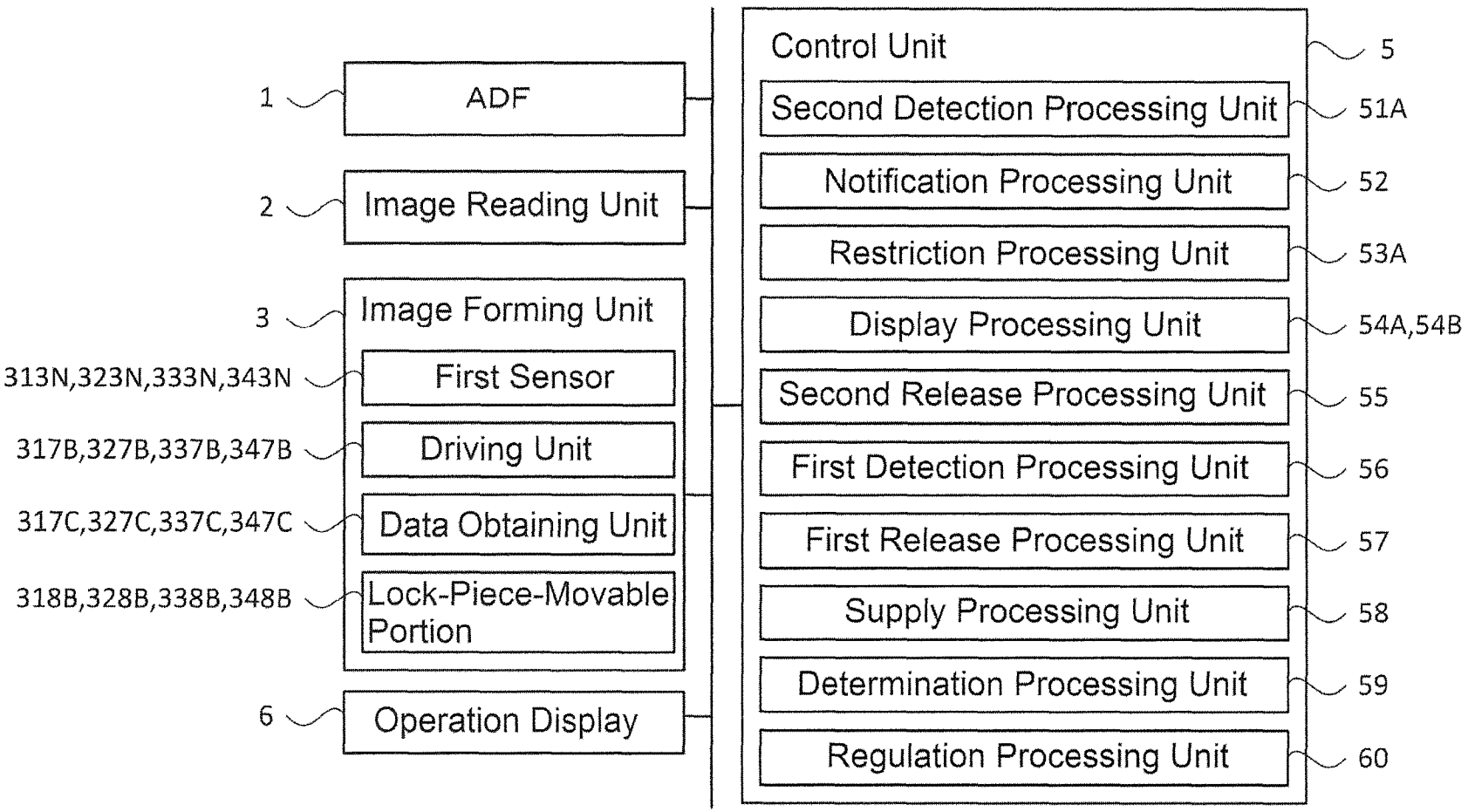
FIG. 2 is a block diagram illustrating a system configuration of the image forming apparatus according to the first embodiment.

First, the following describes a configuration of the image forming apparatus 10 according to the embodiments of the disclosure with reference to FIG. 1 and FIG. 2. FIG. 1 schematically illustrates a cross section showing the configuration of the image forming apparatus 10. The following gives an explanation defining a vertical direction in a paper of FIG. 1 as a vertical direction D1 of the image forming apparatus 10, a lateral direction in the paper as a front-rear direction D2 of the image forming apparatus 10, and a far side in the paper as a lateral direction D3 of the image forming apparatus 10.

The image forming apparatus 10 is a multi-functional peripheral that has a plurality of functions such as a scan function, a facsimile function, and a copy function, as well as a print function, which forms images based on image data. The disclosure is applicable to an image forming apparatus such as a printing device, a facsimile device, and a copying machine.

As illustrated in FIG. 1 and FIG. 2, the image forming apparatus 10 includes an ADF 1, an image reading unit 2, an image forming unit 3, a paper sheet feeder 4, a control unit 5, and an operation display 6.

The paper sheet feeder 4 supplies the image forming unit 3 with sheets. For example, the sheet is a sheet material such as a paper, a coated paper, a postcard, an envelope, and an OHP sheet.

The control unit 5 includes a control instrument such as a CPU, a ROM, a RAM, and an EEPROM (registered trademark) (not illustrated). The CPU is a processor that executes various kinds of arithmetic processing. The ROM is a non-volatile storage unit that preliminary stores information such as a control program to cause the CPU to execute various processes. The RAM is a volatile storage unit and the EEPROM is a non-volatile storage unit. The RAM and the EEPROM are used as a temporary memory (work area) for the various processes executed by the CPU. The control unit 5 causes the CPU to execute the various control programs, which are preliminary stored in the ROM. Accordingly, the control unit 5 integrally controls the image forming apparatus 10. The control unit 5 may be configured of an electronic circuit such as an integrated circuit (ASIC). The control unit 5 may be a control unit located separately from a main control unit, which integrally controls the image forming apparatus 10.

The operation display 6 includes a display such as a liquid crystal display, which displays various pieces of information according to a control instruction from the control unit 5, and an operation unit such as an operation key or a touch panel through which various pieces of information is input to the control unit 5 according to a user's operation. The operation display 6 is one example of the operation unit and the display of the disclosure.

Configuration of Image Forming Unit 3

Figure 3:
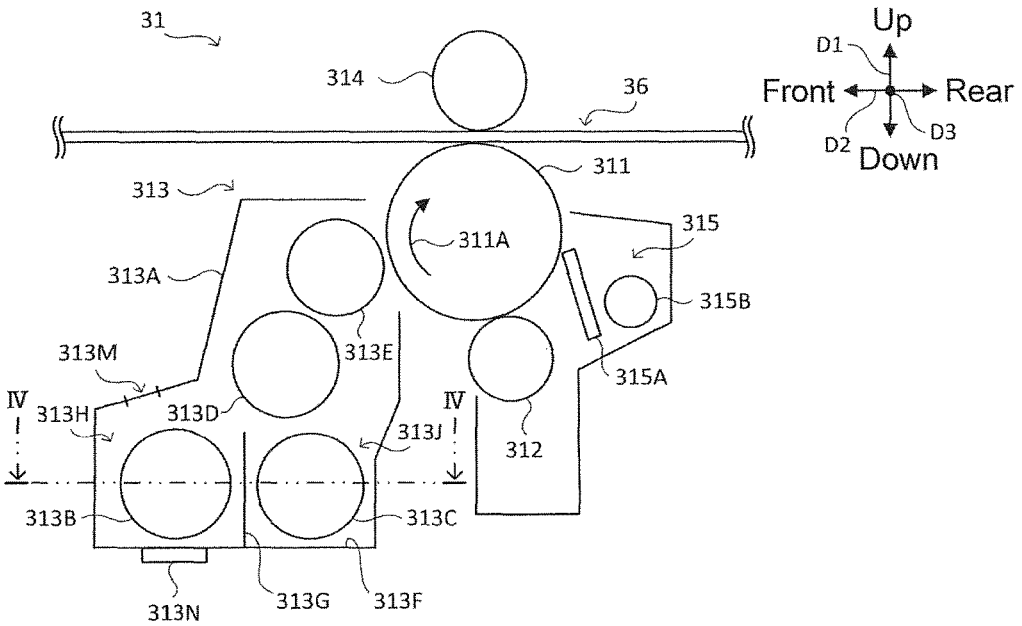
FIG. 3 illustrates a configuration of an electrophotographic process unit of the image forming apparatus according to the first embodiment.
Figure 4:
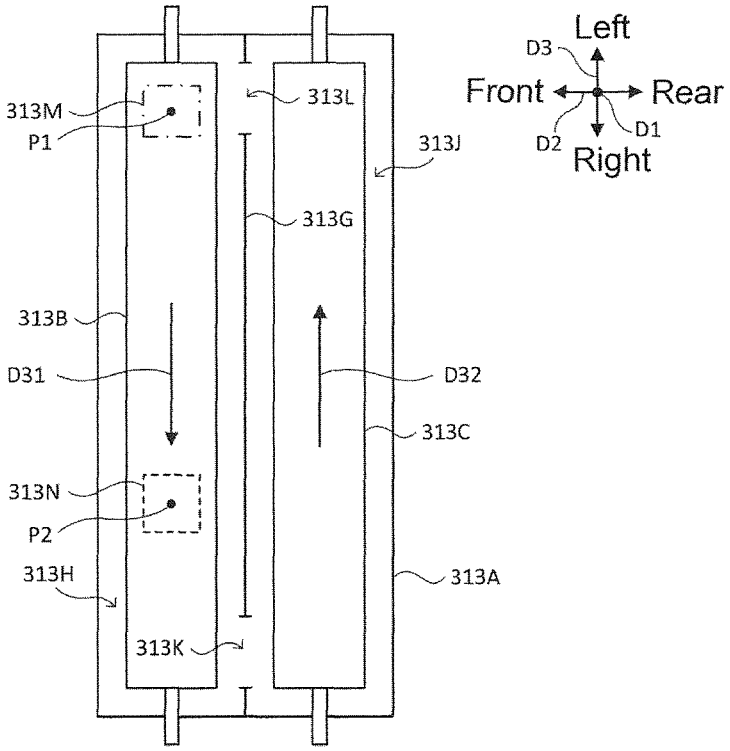
FIG. 4 illustrates a configuration of a developing unit of the image forming apparatus according to the first embodiment.
Figure 5:
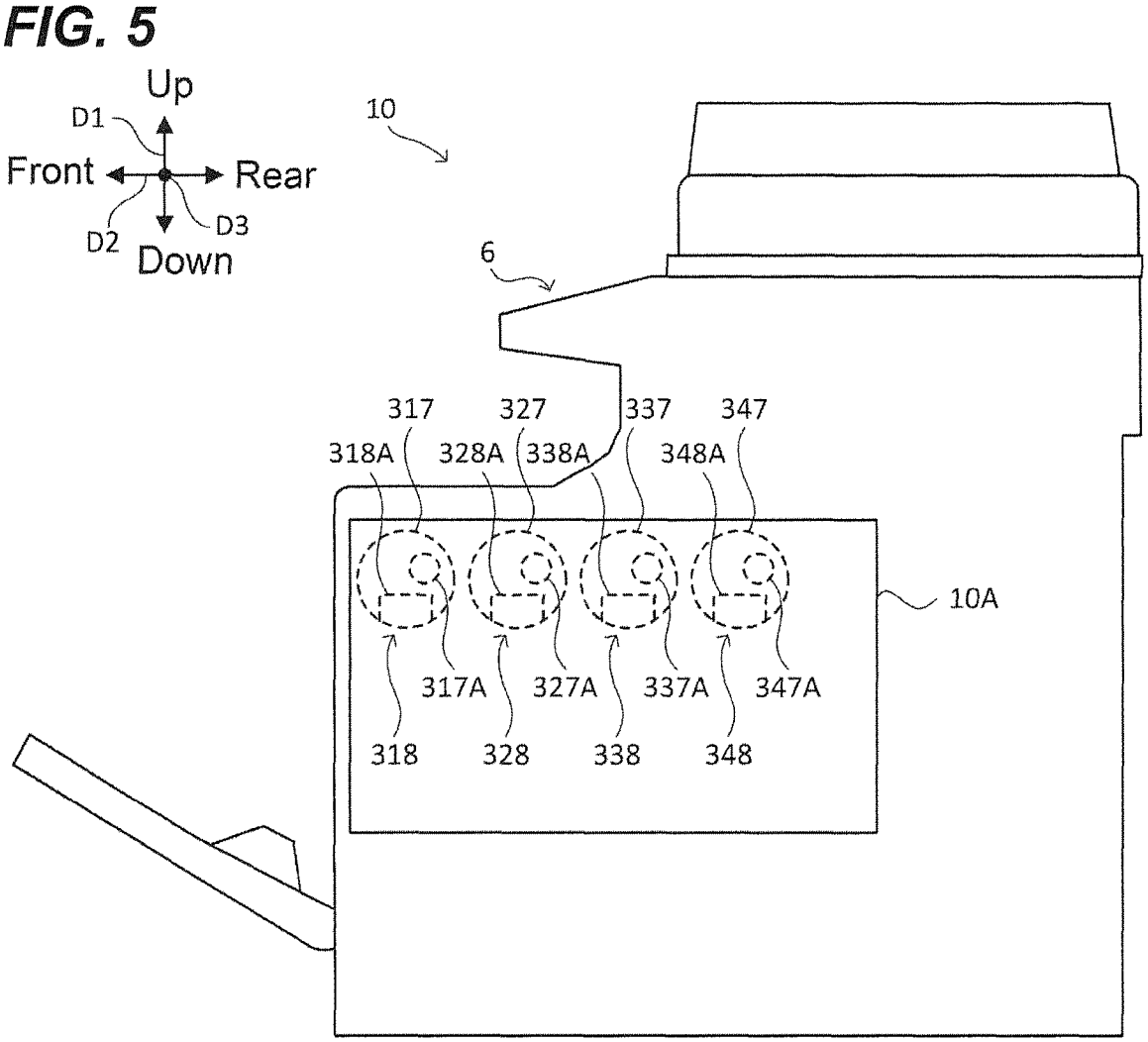
FIG. 5 illustrates a configuration of a mounting portion and a lock mechanism of the image forming apparatus according to the first embodiment.

The following describes the configuration of the image forming unit 3 with reference to FIGS. 1 to 5. FIG. 3 schematically illustrates a cross section showing a configuration of an electrophotographic process unit 31. FIG. 4 illustrates a cross-sectional view viewed from an arrow IV-IV in FIG. 3. FIG. 5 schematically illustrates a configuration of a right-side surface of the mage forming apparatus 10. An alternate long and short dash line in FIG. 4 indicates a position of an opening 313M on a developing unit 313.

The mage forming unit 3 can execute an image formation process (printing process) that forms a color or a monochrome image by electrophotographic method based on image data read by the image reading unit 2. The image forming unit 3 can also execute the printing process based on the image data input from an information processing device such as an external personal computer.

As illustrated in FIG. 1, the image forming unit 3 includes a plurality of electrophotographic process units 31 to 34, a light scanning device 35, an intermediate transfer belt 36, a secondary transfer roller 37, a fixing unit 38, and a sheet discharge tray 39.

The electrophotographic process unit 31, the electrophotographic process unit 32, the electrophotographic process unit 33, and the electrophotographic process unit 34 are image forming units of electrophotographic method corresponding to Y (yellow), C (cyan), M (magenta), and K (black), respectively. As illustrated in FIG. 1, the electrophotographic process units 31 to 34 are located together in the order of yellow, cyan, magenta, and black from the front side of the image forming apparatus 10 along the front-rear direction D2 of the mage forming apparatus 10.

As illustrated in FIG. 3, the electrophotographic process unit 31 includes a photoreceptor drum 311, a charging roller 312, the developing unit 313, a primary transfer roller 314, and a drum cleaning unit 315. The image forming units 32 to 34 each have the configurations similar to the electrophotographic process unit 31. For example, as illustrated in FIG. 1, the image forming units 32 to 34 include developing units 323 to 343.

An electrostatic latent image is formed on a surface of the photoreceptor drum 311. The photoreceptor drum 311 is one example of an image carrier of the disclosure.

The charging roller 312 charges the photoreceptor drum 311.

The developing unit 313 develops the electrostatic latent image formed on the photoreceptor drum 311 using developer containing toner (one example of the developer of the disclosure) and a carrier. Details of the developing unit 313 will be described later.

The primary transfer roller 314 transfers a toner image formed on the surface of the photoreceptor drum 311 by the developing unit 313 to the intermediate transfer belt 36.

The drum cleaning unit 315 removes toner remained on the surface of the photoreceptor drum 311.

The light scanning device 35 forms the electrostatic latent image on the surfaces of the photoreceptor drums provided with the respective electrophotographic process units 31 to 34.

The intermediate transfer belt 36 is an endless belt member to which the toner images formed on the surfaces of the photoreceptor drums provided with the respective electrophotographic process units 31 to 34 are transferred. Rotatably driving the drive roller by a driving power supplied from a power source (not illustrated) moves the intermediate transfer belt 36 along the front-rear direction D2 of the image forming apparatus 10.

The secondary transfer roller 37 transfers the toner image attached to a surface of the intermediate transfer belt 36 to the sheet.

The fixing unit 38 fuses the toner image transferred to the sheet by the secondary transfer roller 37 to the sheet.

The sheet to which the toner image is fixed by the fixing unit 38 is discharged to the sheet discharge tray 39.

The image forming unit 3 forms a color image to the sheet supplied from the paper sheet feeder 4 by the following procedure. The sheet is discharged to the sheet discharge tray 39 after the image formation.

First, in the electrophotographic process unit 31, the charging roller 312 evenly charges the photoreceptor drum 311 at a predetermined electric potential. Next, the light scanning device 35 irradiates the surface of the photoreceptor drum 311 with light based on the image data. This forms the electrostatic latent image corresponding to the image data on the surface of the photoreceptor drum 311. The developing unit 313 develops (visualizes and images) the electrostatic latent image on the photoreceptor drum 311 as yellow toner image.

Subsequently, the primary transfer roller 314 transfers the yellow toner image formed on the photoreceptor drum 311 to the intermediate transfer belt 36. Meanwhile, the drum cleaning unit 315 removes the toner remained on the surface of the photoreceptor drum 311. For example, a cleaning member 315A of the drum cleaning unit 315 removes the toner remained on the surface of the photoreceptor drum 311. A transport screw 315B conveys the toner removed by the cleaning member 315A to a toner housing container (not illustrated) for recovery.

With the image forming units 32 to 34, similar to the process procedure for the electrophotographic process unit 31, the toner images of the respective colors are formed on the photoreceptor drums, which are provided with the image forming units 32 to 34. The toner images are superimposed in the order of yellow, cyan, magenta, and black on the intermediate transfer belt 36 and are transferred. The secondary transfer roller 37 transfers the toner image transferred to the intermediate transfer belt 36 to the sheet supplied from the paper sheet feeder 4. Afterwards, the fixing unit 38 fuses the toner image to form the image to the sheet to which the toner image is transferred, and the sheet is discharged to the sheet discharge tray 39.

The following describes the developing unit 313 in detail. Configurations of the respective developing units 323 to 343 are common to a configuration of the developing unit 313 described below.

As illustrated in FIGS. 3 and 4, the developing unit 313 includes a housing 313A, a first conveying member 313B, a second conveying member 313C, a magnet roller 313D, a developing roller 313E, and a first sensor 313N.

As illustrated in FIG. 3, the housing 313A houses the first conveying member 313B, the second conveying member 313C, the magnet roller 313D, and the developing roller 313E. The housing 313A houses the developer. Specifically, the housing 313A houses the developer in an internal space formed by sidewalls and a bottom surface 313F.

As illustrated in FIG. 4, the housing 313A includes a first conveyance path 313H and a second conveyance path 313J that convey the developer containing the toner. Specifically, as illustrated in FIGS. 3 and 4, a partition wall 313G is located at the bottom surface 313F of the housing 313A. The sidewalls, the bottom surface 313F, and the partition wall 313G of the housing 313A form the first conveyance path 313H, which conveys the developer, at the inside of the housing 313A. The sidewalls, the bottom surface 313F, and the partition wall 313G of the housing 313A form the second conveyance path 313J, which conveys the developer, at the inside of the housing 313A.

As illustrated in FIG. 4, the first conveying member 313B is located at the first conveyance path 313H. The first conveying member 313B conveys the developer along a right direction D31 among the lateral direction D3 in the first conveyance path 313H and charges the toner contained in the developer. Specifically, the first conveying member 313B mixes the developer during the conveyance of the developer to charge the toner contained in the developer. For example, the first conveying member 313B is a mixing screw.

As illustrated in FIG. 4, the second conveying member 313C is located at the second conveyance path 313J. The second conveying member 313C conveys the developer along a left direction D32 among the lateral direction D3 in the second conveyance path 313J and charges the toner contained in the developer. Specifically, the second conveying member 313C mixes the developer during the conveyance of the developer to charge the toner contained in the developer. For example, the second conveying member 313C is the mixing screw.

A first connecting portion 313K, which connects the first conveyance path 313H with the second conveyance path 313J, is located at downstream in the conveyance direction of the developer by the first conveying member 313B at the partition wall 313G. Meanwhile, a second connecting portion 313L, which connects the first conveyance path 313H with the second conveyance path 313J, is located at the downstream in the conveyance direction of the developer by the second conveying member 313C at the partition wall 313G. Accordingly, the developer housed in the housing 313A circulates around and is conveyed through the first conveyance path 313H and the second conveyance path 313J by the first conveying member 313B and the second conveying member 313C.

The magnet roller 313D obtains the developer conveyed by the second conveying member 313C. The magnet roller 313D supplies the toner contained in the developer obtained from the second conveying member 313C to the developing roller 313E. The developing roller 313E uses the toner supplied from the magnet roller 313D to develop the electrostatic latent image formed on the surface of the photoreceptor drum 311.

A development method by the developing unit 313 is not limited to the above-described two-component development method using the developer containing the toner and the carrier. For example, the development method for the developing unit 313 may be one-component development method using only the toner. The developing unit 313 may be a configuration without the magnet roller 313D.

The opening 313M is located at an upstream in the conveyance direction of the developer by the first conveying member 313B at the first conveyance path 313H. For example, as illustrated in FIG. 3, the opening 313M is located at the top surface of the housing 313A at the upper portion of the first conveyance path 313H. The opening 313M is used to carry the toner supplied from a toner container 316, which will be described later, to the first conveyance path 313H. Specifically, the toner supplied from the toner container 316 is carried in a carry-in position P1 (see FIG. 4) at the first conveyance path 313H via the opening 313M.

The first sensor 313N detects an amount of toner at a detecting position P2 (see FIG. 4). The detecting position P2 is positioned at the downstream in the conveyance direction of the developer by the first conveying member 313B with respect to the opening 313M at the first conveyance path 313H. For example, as illustrated in FIG. 3, the first sensor 313N is located at a bottom portion of the housing 313A. For example, the first sensor 313N is a magnetic permeability sensor including an LC oscillation circuit that outputs electric signals according to a magnetic permeability of the developer housed in the housing 313A. The first sensor 313N is one example of a first developer detecting unit of the disclosure.

For example, the image forming apparatus 10 integrates respective detected values detected by the first sensor 313N during a detection period exceeding a conveyance period of the toner from the carry-in position P1 to the detecting position P2 by the first conveying member 313B to obtain the remaining amount of the developer in the developing unit 313. For example, the detection period is a period during which the toner conveyed by the first conveying member 313B takes a round of the inside of the developing unit 313. The detection period may be longer or shorter than the period during which the toner conveyed by the first conveying member 313B takes a round of the inside of the developing unit 313.

As illustrated in FIG. 1, toner containers 316 to 346 are mounted to the image forming unit 3. The toner container 316 houses the yellow toner supplied to the electrophotographic process unit 31. The toner container 326 houses the cyan toner supplied to the electrophotographic process unit 32. The toner container 336 houses the magenta toner supplied to the electrophotographic process unit 33. The toner container 346 houses the black toner supplied to the electrophotographic process unit 34. The toner containers 316 to 346 have the common configuration except for the toner colors to be housed. Therefore, the following explains only the toner container 316.

For example, the toner container 316 is a long, approximately cylindrical-shaped container along the lateral direction D3. The toner container 316 includes a conveying member (not illustrated), which conveys the toner at the inside of the toner container 316, and an IC tag (not illustrated), which stores specification data regarding the toner container 316. For example, the specification data includes information such as identification information and quality determination information of the toner container 316, the toner color to be housed, and the remaining amount of the housed toner.

As illustrated in FIG. 1 and FIG. 5, the image forming unit 3 further includes mounting portions 317 to 347 and lock mechanisms 318 to 348. The mounting portions 317 to 347 have the common configuration except for the mounted toner containers. The lock mechanisms 318 to 348 have the common configuration except for the toner containers whose attachment/removal are regulated. Therefore, the following explains only the mounting portion 317 and the lock mechanism 318.

The toner container 316 is mounted to the mounting portion 317. For example, as illustrated in FIG. 1 and FIG. 5, the mounting portion 317 is located long in the lateral direction D3 at an upper portion of the image forming unit 3. As illustrated in FIG. 5, a housing cover 10A covers the mounting portion 317. The toner container 316 is one example of the developer housing portion of the disclosure.

The housing cover 10A is an openable/closable cover member externally mounted to the image forming apparatus 10. Specifically, as illustrated in FIG. 5, the housing cover 10A is located corresponding to the arranged positons of the mounting portions 317 to 347 on the right-side surface of the image forming apparatus 10. For example, the housing cover 10A is opened and closed with a hinge located at any one of end portions in the front-rear direction D2. To attach or remove any one of the toner containers 316 to 346, the housing cover 10A is opened and the mounting portions 317 to 347 are exposed to the outside. An open/close detection switch (not illustrated) to detect the opening and closing of the housing cover 10A is located at an end portion on a side opposite to the end portion where the hinge of the housing cover 10A is located. With the open/close detection switch, the electric signal corresponding to the open/close state of the housing cover 10A is input to the control unit 5. The housing cover 10A is one example of a cover member of the disclosure.

As illustrated in FIG. 5, a connecting portion 317A is located at a left end portion in the lateral direction D3 on the mounting portion 317. The connecting portion 317A engages with the conveying member provided with the toner container 316 mounted to the mounting portion 317. For example, the connecting portion 317A is a gear. The image forming unit 3 includes a driving unit 317B (see FIG. 2) such as a motor that supplies the driving power to the conveying member of the toner container 316, which is mounted to the mounting portion 317, via the connecting portion 317A. The driving power supplied from the driving unit 317B via the connecting portion 317A drives the conveying member to supply the toner from the toner container 316 to the electrophotographic process unit 31.

The mounting portion 317 includes a data obtaining unit 317C (see FIG. 2) that obtains the specification data from the IC tag provided with the toner container 316. For example, the data obtaining unit 317C performs wireless communications with the IC tag, which is provided with the toner container 316 mounted to the mounting portion 317, to receive the specification data from the IC tag.

The lock mechanism 318 regulates the attachment/removal of the toner container 316 mounted to the mounting portion 317. For example, as illustrated in FIGS. 2 and 5, the lock mechanism 318 includes a lock piece 318A and a lock-piece-movable portion 318B. As illustrated in FIG. 5, the lock piece 318A is located a right end portion in the lateral direction D3 on the mounting portion 317. For example, the lock piece 318A is movably located along the vertical direction D1 between a blocking position, which blocks the right end portion of the mounting portion 317, and a release position, which releases the right end portion of the mounting portion 317. The lock-piece-movable portion 318B moves the lock piece 318A between the blocking position and the release position. For example, the lock-piece-movable portion 318B is a solenoid. For example, the lock mechanism 318 holds the lock piece 318A at any one of the blocking position and the release position according to whether an electric power is supplied from a power supply unit (not illustrated) to the lock-piece-movable portion 318B.

When detecting a first state (out of toner), the image forming apparatus 10 releases the regulation on the attachment/removal of the toner container 316 by the lock mechanism 318. The first state is a state where the remaining amount of the toner housed in the toner container 316 is less than a predetermined first reference amount.

When the first state is detected and the toner container 316 is exchanged, the image forming apparatus 10 executes a supply process. The supply process supplies the toner from the toner container 316 to the developing unit 313 until the remaining amount of the toner in the developing unit 313 obtained by the first sensor 313N exceeds a predetermined threshold.

The image forming apparatus 10 halts the printing process according to the detection of the first state in some cases. The image forming apparatus 10 reduces a print density of a printed matter output immediately before the detection of the first state in some cases. Therefore, the user of the image forming apparatus 10 probably wants to exchange the toner container 316 before the detection of the first state. However, when the regulation on the attachment/removal of the toner container 316 by the lock mechanism 318 is released according to the detection of the first state, the toner container 316 cannot be exchanged until the first state is detected.

In contrast to this, the image forming apparatus 10 according to the embodiment of the disclosure can reduce the remaining amount of the toner in the toner container 316 during exchange and can exchange the toner container 316 before the detection of the first state as described later.

First Embodiment

The following describes the image forming apparatus 10 according to the first embodiment of the disclosure.

The image forming apparatus 10 according to the first embodiment of the disclosure preliminary stores a first attachment/removal deregulation program to cause the CPU to execute a first attachment/removal deregulation process, which will be described later, (see the flowchart in FIG. 6) and an attachment/removal regulation process (see the flowchart in FIG. 7) in the ROM of the control unit 5. A computer-readable recording medium such as a CD, a DVD, and a flash memory may record the first attachment/removal deregulation program. The first attachment/removal deregulation program may be read from the recording medium and installed on a storage unit such as the EEPROM in the control unit 5.

As illustrated in FIG. 2, the control unit 5 includes a second detection processing unit 51A, a notification processing unit 52, a restriction processing unit 53A, a display processing unit 54A, a second release processing unit 55, a first detection processing unit 56, a first release processing unit 57, a supply processing unit 58, a determination processing unit 59, and a regulation processing unit 60. Specifically, the control unit 5 uses the CPU to execute the first attachment/removal deregulation program stored on the ROM. Accordingly, the control unit 5 functions as the second detection processing unit 51A, the notification processing unit 52, the restriction processing unit 53A, the display processing unit 54A, the second release processing unit 55, the first detection processing unit 56, the first release processing unit 57, the supply processing unit 58, the determination processing unit 59, and the regulation processing unit 60.

The following gives an explanation with the developing unit 313, the toner container 316, the mounting portion 317, and the lock mechanism 318 as examples. The following description is similarly applicable to the developing units 323 to 343, the toner container 326 to 346, mounting portions 327 to 347, and lock mechanisms 328 to 348.

The second detection processing unit 51A detects a second state. The second state is a state where the remaining amount of the toner housed in the toner container 316 mounted to the mounting portion 317 is equal to or more than the first reference amount and less than a predetermined second reference amount larger than the first reference amount.

For example, the second detection processing unit 51A detects the second state of the toner container 316 based on the remaining amount of the toner in the developing unit 313 obtained by the first sensor 313N. For example, the second detection processing unit 51A detects the second state based on an increase rate of the remaining amount of the toner in the developing unit 313 obtained by the first sensor 313N when the toner is supplied from the toner container 316 to the developing unit 313 while the printing process is in execution.

The second detection processing unit 51A may detect the second state as follows. The second detection processing unit 51A calculates a consumption amount of the toner based on a printing rate of the image data printed in the printing process and compares an accumulated value of the calculated consumption amount of the toner with an amount of tonner housed in the toner container 316. The second detection processing unit 51A may detect the second state as follows. The second detection processing unit 51A calculates an amount of carried-out toner from the toner container 316 based on a driving period of the conveying member by the driving unit 317B and compares an accumulated value of the calculated amount of carried-out toner with the amount of tonner housed in the toner container 316.

When the second detection processing unit 51A detects the second state of the toner container 316, the notification processing unit 52 notifies the state.

When the door opening of the housing cover 10A is detected, the restriction processing unit 53A restricts the execution of the printing process by the image forming unit 3. For example, the restriction processing unit 53A uses the open/close detection switch to detect the door opening of the housing cover 10A.

For example, when the door opening of the housing cover 10A is detected while the printing process is in execution, the restriction processing unit 53A halts the printing process after a printed matter during printing is output. When the printing process is not executed while the door opening of the housing cover 10A is detected, the restriction processing unit 53A inhibits the execution of the printing process.

When the second detection processing unit 51A detects the second state and the door opening of the housing cover 10A is detected, the display processing unit 54A displays a release operation screen, which is used for the release operation of the regulation on the attachment/removal of the toner container 316 by the lock mechanism 318, on the operation display 6.

For example, when the second detection processing unit 51A detects the second state and the open/close detection switch detects the door opening of the housing cover 10A, the display processing unit 54A displays the release operation screen on the operation display 6.

For example, the display processing unit 54A causes the release operation screen, which includes a message indicative of the remnant of toner in the toner container 316 mounted to the mounting portion 317, to be displayed.

When the second detection processing unit 51A detects the second state and the predetermined release condition is met, the second release processing unit 55 causes the lock mechanism 318 to release the regulation on the attachment/removal of the toner container 316.

For example, the release condition is that the release operation of the regulation on the attachment/removal of the toner container 316 by the lock mechanism 318 is executed in the release operation screen, which is displayed by the display processing unit 54A. The release condition may be a switch operation (not illustrated) located inside the housing of the image forming apparatus 10.

For example, the second release processing unit 55 causes the power supply unit to supply the electric power to the lock-piece-movable portion 318B. Accordingly, in the lock mechanism 318, the lock piece 318A is moved from the blocking position to the release position and is held at the release position.

The first detection processing unit 56 detects the first state where the remaining amount of the toner housed in the toner container 316 mounted to the mounting portion 317 is less than the first reference amount.

For example, similar to the second detection processing unit 51A, the first detection processing unit 56 detects the first state of the toner container 316 based on the remaining amount of the toner in the developing unit 313 obtained by the first sensor 313N. For example, the first detection processing unit 56 detects the first state based on the increase rate of the remaining amount of the toner in the developing unit 313 obtained by the first sensor 313N when the toner is supplied from the toner container 316 to the developing unit 313 during the execution of the printing process.

The first detection processing unit 56 may detect the first state as follows. The first detection processing unit 56 calculates the consumption amount of the toner based on the printing rate of the image data printed in the printing process and compares the accumulated value of the calculated consumption amount of toner with the amount of tonner housed in the toner container 316. The first detection processing unit 56 may detect the first state as follows. The first detection processing unit 56 calculates the amount of carried-out toner from the toner container 316 based on the driving period of the conveying member by the driving unit 317B and compares an accumulated value of the calculated amount of carried-out toner with the amount of the tonner housed in the toner container 316.

When the first detection processing unit 56 detects the first state, the first release processing unit 57 releases the regulation on the attachment/removal of the toner container 316 by the lock mechanism 318.

For example, similar to the second release processing unit 55, the first release processing unit 57 causes the power supply unit to supply the electric power to the lock-piece-movable portion 318B. Accordingly, in the lock mechanism 318, the lock piece 318A is moved from the blocking position to the release position and is held at the release position.

When it is determined that the toner container 316 where the regulation on the attachment/removal is released by the second release processing unit 55 or the first release processing unit 57 is exchanged, the supply processing unit 58 executes the supply process. The supply process causes the toner to be supplied from the toner container 316 to the developing unit 313 until the remaining amount of the toner in the developing unit 313 detected by the first sensor 313N exceeds the threshold.

For example, the image forming apparatus 10 includes a sensor (not illustrated) that can detect whether the toner container 316 is mounted to the mounting portion 317. For example, when the second release processing unit 55 releases the regulation on the attachment/removal of the toner container 316, the supply processing unit 58 determines whether the toner container 316 is mounted to the mounting portion 317 using the sensor when the open/close detection switch detects the closing of the housing cover 10A. When it is determined that the toner container 316 is mounted to the mounting portion 317, the supply processing unit 58 determines that the toner container 316 has been exchanged.

When the first release processing unit 57 releases the regulation on the attachment/removal of the toner container 316, the supply processing unit 58 determines whether the toner container 316 is mounted to the mounting portion 317 using the sensor when the open/close detection switch detects the closing of the housing cover 10A after the door opening of the housing cover 10A. When it is determined that the toner container 316 is mounted to the mounting portion 317, the supply processing unit 58 determines that the toner container 316 has been exchanged.

When the second release processing unit 55 releases the regulation on the attachment/removal of the toner container 316 and the closing of the housing cover 10A is detected using the open/close detection switch, the supply processing unit 58 may determine that the toner container 316 has been exchanged. When the first release processing unit 57 releases the regulation on the attachment/removal of the toner container 316 and the closing of the housing cover 10A after the door opening of the housing cover 10A is detected using the open/close detection switch, the supply processing unit 58 may determine that the toner container 316 has been exchanged. When the predetermined operation is executed with the operation display 6 after the second release processing unit 55 or the first release processing unit 57 releases the regulation on the attachment/removal of the toner container 316, the supply processing unit 58 may determine that the toner container 316 mounted to the mounting portion 317 has been exchanged.

For example, the supply processing unit 58 controls the driving unit 317B to drive the conveying member of the toner container 316 in the supply process.

The determination processing unit 59 determines whether the toner container 316 mounted to the mounting portion 317 is a predetermined specific type toner container. For example, the specific type toner container is a toner container manufactured by one or a plurality of predetermined manufacturing entities.

For example, when the supply processing unit 58 executes the supply process, the determination processing unit 59 causes the data obtaining unit 317C to obtain the specification data from the IC tag in the toner container 316. The determination processing unit 59 determines whether the toner container 316 mounted to the mounting portion 317 is the specific type toner container based on the identification information or the quality determination information included in the specification data.

The regulation processing unit 60 causes the lock mechanism 318 to regulate the attachment/removal of the toner container 316 to which the supply process has been executed.

For example, when the determination processing unit 59 determines that the toner container 316 to which the supply process has been executed is the specific type toner container, the regulation processing unit 60 causes the lock mechanism 318 to regulate the attachment/removal of the toner container 316.

For example, the regulation processing unit 60 causes the power supply unit to stop supplying the electric power to the lock-piece-movable portion 318B. Accordingly, in the lock mechanism 318, the lock piece 318A is moved from the release position to the blocking position and is held at the blocking position.

When the determination processing unit 59 determines that the toner container 316 is not the specific type toner container, the notification processing unit 52 notifies the fact.

When the determination processing unit 59 determines that the toner container 316 is not the specific type toner container to which the supply process has been executed, the regulation processing unit 60 may cause the lock mechanism 318 to regulate the attachment/removal of the toner container 316.

First Attachment/Removal Deregulation Process

Figure 6:
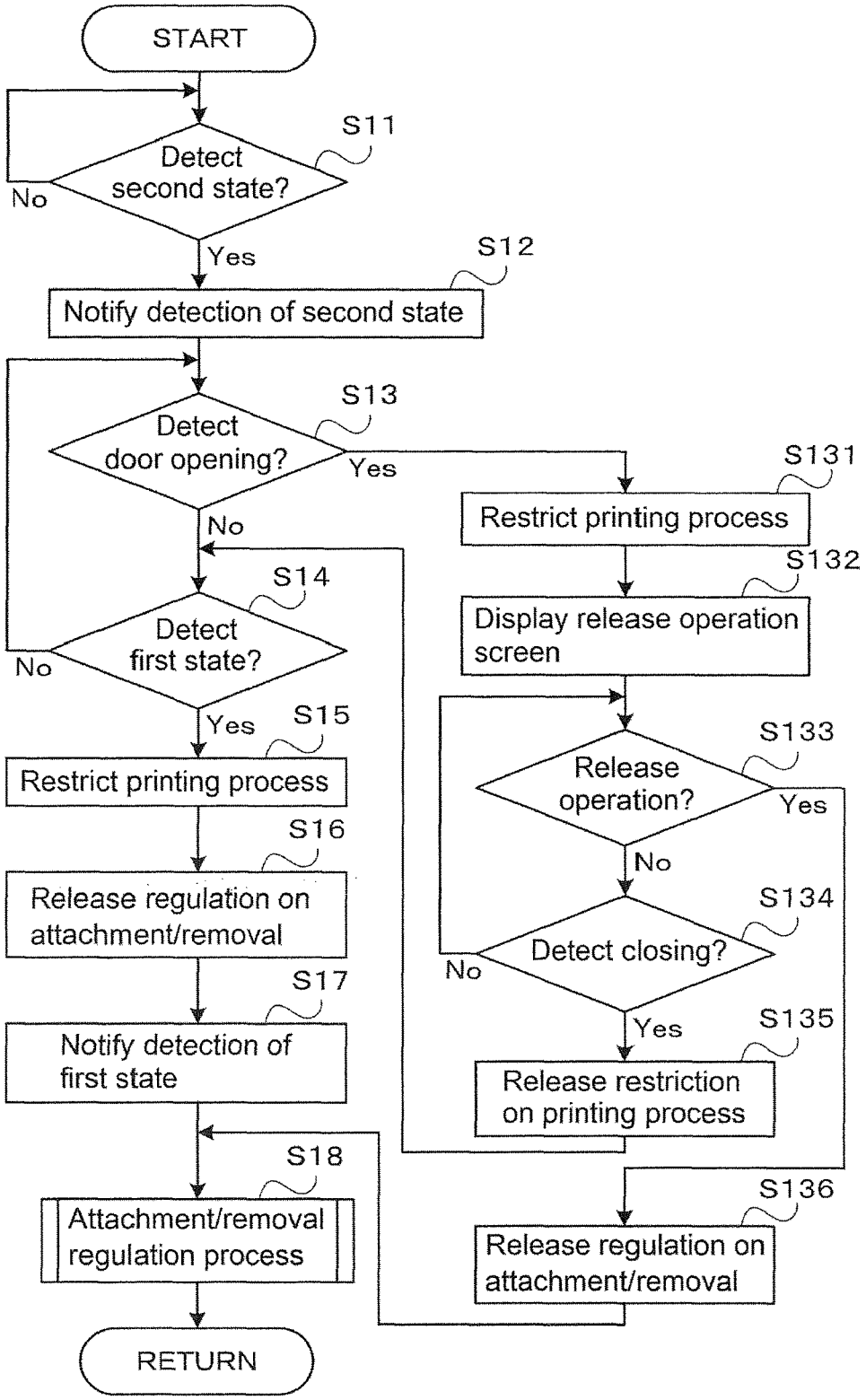
FIG. 6 illustrates one example of a first attachment/removal deregulation process executed by the image forming apparatus according to the first embodiment.

The following describes one example of a procedure for the first attachment/removal deregulation process executed by the control unit 5 in the image forming apparatus 10 with reference to FIG. 6. Here, Steps S11, S12, and so on denote process procedures (steps) executed by the control unit 5.

Step S11

First, at Step S11, the control unit 5 determines whether the second state where the remaining amount of the toner housed in the toner container 316 mounted to the mounting portion 317 is equal to or more than the first reference amount and less than the second reference amount is detected. The process at Step S11 is one example of a second step in the disclosure and is executed by the second detection processing unit 51A in the control unit 5.

For example, the control unit 5 detects the second state of the toner container 316 based on the remaining amount of the toner in the developing unit 313 obtained by the first sensor 313N. For example, the control unit 5 detects the second state based on the increase rate of the remaining amount of the toner in the developing unit 313 obtained by the first sensor 313N when the toner is supplied from the toner container 316 to the developing unit 313 during the execution of the printing process.

Here, when determining that the second state has been detected (Yes at Step S11), the control unit 5 transitions the process to Step S12. When the second state is not detected (No at Step S11), the control unit 5 waits for the detection of the second state at Step S11.

Step S12

At Step S12, the control unit 5 notifies that the second state of the toner container 316 has been detected. Here, the notification processing unit 52 in the control unit 5 executes the process at Step S12.

For example, the control unit 5 displays a message indicative of the detection of the second state of the toner container 316 on the operation display 6. This allows the user to recognize the reduction in remaining amount of the toner in the toner container 316 and to prepare the new toner container 316 before the toner in the toner container 316 runs out. This also allows the user to recognize that the exchange of the toner container 316 becomes possible. The process at Step S12 may be omitted.

Step S13

At Step S13, the control unit 5 determines whether the door opening of the housing cover 10A is detected. For example, the control unit 5 detects the door opening of the housing cover 10A using the open/close detection switch.

Here, when determining that the door opening of the housing cover 10A has been detected (Yes at Step S13), the control unit 5 transitions the process to Step S131. When the door opening of the housing cover 10A (No at Step S13) is not detected, the control unit 5 transitions the process to Step S14.

Step S14

At Step S14, the control unit 5 determines whether the first state where the remaining amount of the toner housed in the toner container 316 mounted to the mounting portion 317 is less than the first reference amount is detected. The process at Step S14 is one example of a first step of the disclosure and is executed by the first detection processing unit 56 in the control unit 5.

For example, similar to Step S11, the control unit 5 detects the first state of the toner container 316 based on the remaining amount of the toner in the developing unit 313 obtained by the first sensor 313N. For example, the control unit 5 detects the first state based on the increase rate of the remaining amount of the toner in the developing unit 313 obtained by the first sensor 313N when the toner is supplied from the toner container 316 to the developing unit 313 during the execution of the printing process.

Here, when determining that the first state has been detected (Yes at Step S14), the control unit 5 transitions the process to Step S15. When the first state is not detected (No at Step S14), the control unit 5 transitions the process to Step S13 and waits for the detection of the door opening of the housing cover 10A or the detection of the first state.

Step S131

When determining that the opening of the housing cover 10A has been detected at Step S13, the control unit 5 executes the process at Step S131. At Step S131, the control unit 5 restricts the execution of the printing process by the image forming unit 3. Here, the restriction processing unit 53A in the control unit 5 executes the process at Step S131.

For example, when the door opening of the housing cover 10A is detected while the printing process is in execution, the control unit 5 outputs the printed matter during printing and then halts the printing process. When the printing process is not in execution while the door opening of the housing cover 10A is detected, the control unit 5 inhibits the execution of the printing process.

Step S132

At Step S132, the control unit 5 displays the release operation screen used for the release operation of the regulation on the attachment/removal of the toner container 316 by the lock mechanism 318 on the operation display 6. Here, the display processing unit 54A in the control unit 5 executes the process at Step S132.

For example, the control unit 5 displays the release operation screen, which includes the message indicative of the remnant toner in the toner container 316 mounted to the mounting portion 317. This allows the user to prompt re-examination of whether exchanging the toner container 316 is necessary. The release operation screen may not include the message.

Step S133

At Step S133, the control unit 5 determines whether the release operation of the regulation on the attachment/removal of the toner container 316 by the lock mechanism 318 has been executed on the release operation screen.

Here, when determining that the release operation of the regulation on the attachment/removal of the toner container 316 has been executed on the release operation screen (Yes at Step S133), the control unit 5 transitions the process to Step S136. When the release operation of the regulation on the attachment/removal of the toner container 316 is not executed on the release operation screen (No at Step S133), the control unit 5 transitions the process to Step S134.

Step S134

At Step S134, the control unit 5 determines whether the closing of the housing cover 10A is detected. For example, the control unit 5 detects the closing of the housing cover 10A using the open/close detection switch.

Here, when determining that the closing of the housing cover 10A is detected (Yes at Step S134), the control unit 5 transitions the process to Step S135. When the closing of the housing cover 10A is not detected (No at Step S134), the control unit 5 transitions the process to Step S133 and waits for the release operation of the regulation on the attachment/removal of the toner container 316 on the release operation screen or the detection of the closing of the housing cover 10A.

Step S135

At Step S135, the control unit 5 releases the restriction on the execution of the printing process at Step S131.

For example, when the printing process is halted at Step S131, the control unit 5 resumes the halted printing process. When the execution of the printing process is inhibited at Step S131, the control unit 5 releases the inhibition of the execution of the printing process.

Step S136

At Step S136, the control unit 5 causes the lock mechanism 318 to release the regulation on the attachment/removal of the toner container 316. The process at Step S136 is one example of a fourth step of the disclosure and is executed by the second release processing unit 55 in the control unit 5.

For example, the control unit 5 causes the power supply unit to supply the electric power to the lock-piece-movable portion 318B. Accordingly, in the lock mechanism 318, the lock piece 318A is moved from the blocking position to the release position and is held at the release position. This ensures exchanging the toner container 316.

Step S15

Meanwhile, when determining that the first state has been detected at Step S14, the control unit 5 executes the process at Step S15. At Step S15, the control unit 5 restricts the execution of the printing process by the image forming unit 3.

For example, when the first state is detected while the printing process is in execution, the control unit 5 outputs the printed matter during printing and then halts the printing process. When the first state is detected while the printing process is not in execution, the control unit 5 inhibits the execution of the printing process. When the first state is detected while the printing process is in execution, the control unit 5 may output the predetermined number of printed matters and then halt the printing process. This avoids the image forming apparatus 10 to output the printed matters at the lowered print density.

Even before the detection of the first state, the image forming apparatus 10 reduces the print density of the printed matters to be output due to the small toner amount housed in in the developing unit 313 in some cases.

Step S16

At Step S16, the control unit 5 causes the lock mechanism 318 to release the regulation on the attachment/removal of the toner container 316. The process at Step S16 is one example of a third step of the disclosure and is executed by the first release processing unit 57 in the control unit 5.

For example, the control unit 5 causes the power supply unit to supply the electric power to the lock-piece-movable portion 318B similar to Step S136. Accordingly, in the lock mechanism 318, the lock piece 318A is moved from the blocking position to the release position and is held at the release position. This ensures exchanging the toner container 316.

Step S17

At Step S17, the control unit 5 notifies that the first state of the toner container 316 has been detected.

For example, the control unit 5 displays a message indicative of the detection of the first state of the toner container 316 on the operation display 6. This allows the user to recognize that the remaining amount of the toner in the toner container 316 runs out and to perform the exchange work of the toner container 316.

Step S18

At Step S18, the control unit 5 executes the attachment/removal regulation process, which will be described later.

Attachment/Removal Regulation Process

Figure 7:
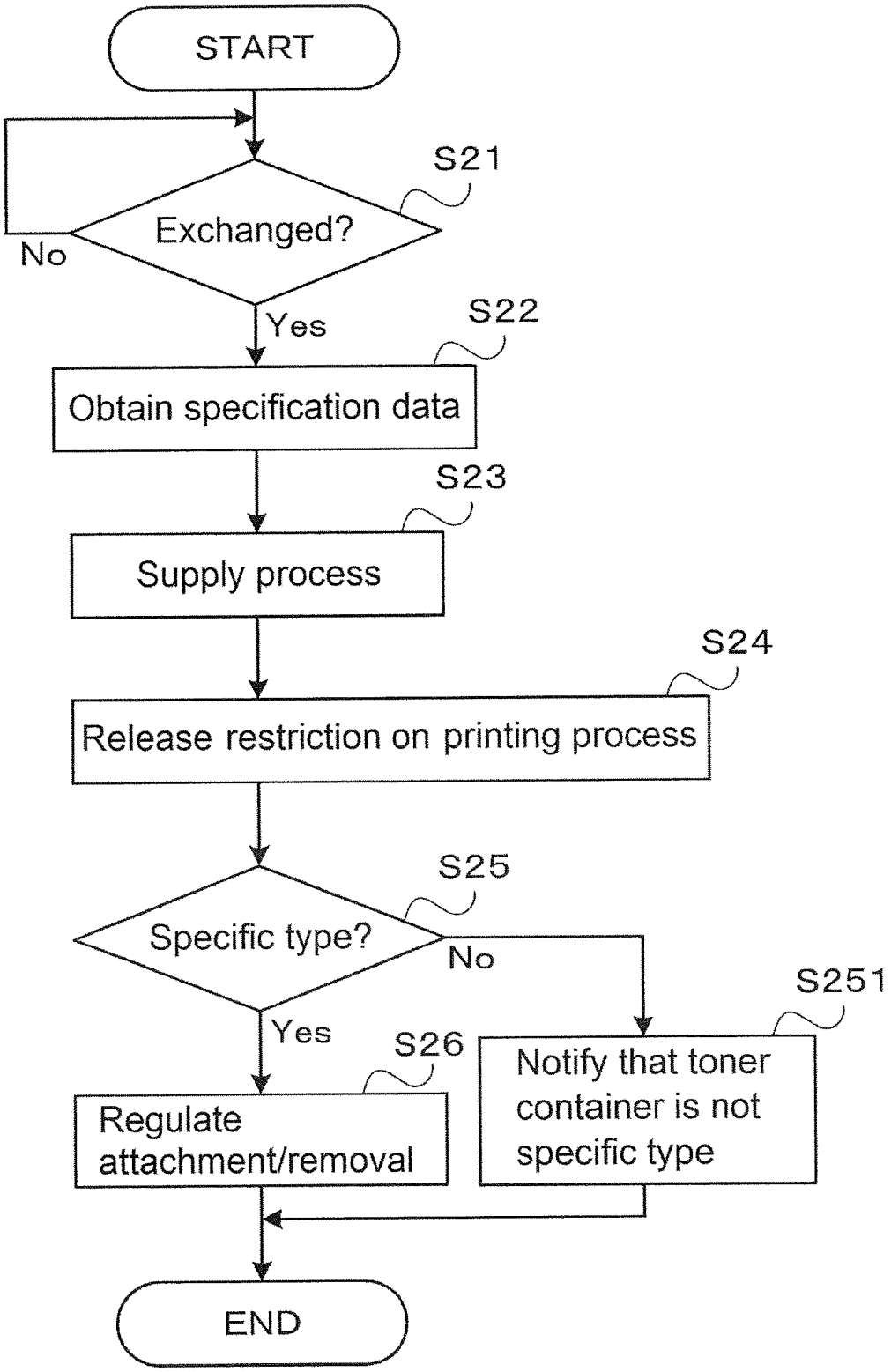
FIG. 7 illustrates one example of an attachment/removal regulation process executed by the image forming apparatus according to the first embodiment.

The following describes one example of a procedure for the attachment/removal regulation process executed at Step S18 in the first attachment/removal deregulation process with reference to FIG. 7.

Step S21

First, at Step S21, the control unit 5 determines whether the toner container 316 has been exchanged.

For example, when the regulation on the attachment/removal of the toner container 316 is released at Step S136 in the first attachment/removal deregulation process, the control unit 5 determines whether the toner container 316 is mounted to the mounting portion 317 using the sensor when the open/close detection switch detects the closing of the housing cover 10A. When determining that the toner container 316 is mounted to the mounting portion 317, the control unit 5 determines that the toner container 316 has been exchanged.

When the regulation on the attachment/removal of the toner container 316 is released at Step S16 in the first attachment/removal deregulation process, the control unit 5 determines whether the toner container 316 is mounted to the mounting portion 317 using the sensor when the open/close detection switch detects the closing of the housing cover 10A after the door opening of the housing cover 10A. When determining that the toner container 316 is mounted to the mounting portion 317, the control unit 5 determines that the toner container 316 has been exchanged.

When determining that the toner container 316 has been exchanged (Yes at Step S21), the control unit 5 transitions the process to Step S22. When the toner container 316 is not exchanged (No at Step S21), the control unit 5 waits for the exchange of the toner container 316 at Step S21.

Step S22

At Step S22, the control unit 5 causes the data obtaining unit 317C to obtain the specification data from the IC tag of the toner container 316.

Step S23

At Step S23, the control unit 5 executes the supply process, which causes the toner to be supplied from the toner container 316 to the developing unit 313 until the remaining amount of the toner in the developing unit 313 detected by the first sensor 313N exceeds the threshold. After the termination of the supply process, the control unit 5 transitions the process to Step S24. Here, the supply processing unit 58 in the control unit 5 executes the process at Step S23.

For example, the control unit 5 controls the driving unit 317B to drive the conveying member of the toner container 316 in the supply process.

Step S24

At Step S24, the control unit 5 releases the restriction on the execution of the printing process at Step S131 or Step S15.

For example, when the printing process is halted at Step S131 or Step S15, the control unit 5 resumes the halted printing process. When the execution of the printing process is inhibited at Step S131 or Step S15, the control unit 5 releases the inhibition of the execution of the printing process.

Step S25

At Step S25, the control unit 5 determines whether the toner container 316 determined as exchanged at Step S21 is the specific type toner container. Here, the determination processing unit 59 in the control unit 5 executes the process at Step S25.

For example, the control unit 5 determines whether the toner container 316 determined as exchanged at Step S21 is the specific type toner container based on the identification information or the quality determination information included in the specification data, which is obtained at Step S22.

Here, when determining that the toner container 316 determined as exchanged at Step S21 is the specific type toner container (Yes at Step S25), the control unit 5 transitions the process to Step S26. When the toner container 316 determined as exchanged at Step S21 is not the specific type toner container (No at Step S25), the control unit 5 transitions the process to Step S251.

Step S26

At Step S26, the control unit 5 causes the lock mechanism 318 to regulate the attachment/removal of the toner container 316. Here, the regulation processing unit 60 in the control unit 5 executes the process at Step S26.

For example, the control unit 5 causes the power supply unit to stop supplying the electric power to the lock-piece-movable portion 318B. Accordingly, in the lock mechanism 318, the lock piece 318A is moved from the release position to the blocking position and is held at the blocking position. This inhibits the exchange of the toner container 316.

Step S251

At Step S251, the control unit 5 notifies that the toner container 316 determined as exchanged at Step S21 is not the specific type toner container. Here, the notification processing unit 52 in the control unit 5 executes the process at Step S251.

For example, the control unit 5 displays the message indicative of the toner container 316 mounted to the mounting portion 317 being not the specific type toner container on the operation display 6. This prompts the user to exchange the toner container 316 mounted to the mounting portion 317 to the specific type toner container.

Thus, with the image forming apparatus 10 according to the first embodiment of the disclosure, when the second state has been detected and the door opening of the housing cover 10A has been detected, the release operation screen, which is used for the release operation of the regulation on the attachment/removal of the toner container 316 by the lock mechanism 318, is displayed. When the release operation of the regulation on the attachment/removal of the toner container 316 is executed on the operation screen, the regulation on the attachment/removal of the toner container 316 by the lock mechanism 318 is released. This ensures a reduction in the remaining amount of the toner in the toner container 316 during exchange and ensures exchanging the toner container 316 before the detection of the first state.

Second Embodiment

The following describes the image forming apparatus 10 according to the second embodiment of the disclosure.

The second embodiment differs from the above-described first embodiment in some configurations of the control unit 5. The other configurations are common between the second embodiment and the above-described first embodiment. Accordingly, in the following description, like reference numerals designate identical elements throughout the above-described first embodiment and the second embodiment, and therefore the detailed explanation will not be further elaborated here.

Specifically, in the second embodiment, the ROM in the control unit 5 preliminary stores a second attachment/removal deregulation program to cause the CPU to execute a second attachment/removal deregulation process (see the flowchart in FIG. 8), which will be described later, and the attachment/removal regulation process (see the flowchart in FIG. 7). As illustrated in FIG. 2, the control unit 5 includes the second detection processing unit 51A, the notification processing unit 52, the restriction processing unit 53A, a display processing unit 54B, the second release processing unit 55, the first detection processing unit 56, the first release processing unit 57, the supply processing unit 58, the determination processing unit 59, and the regulation processing unit 60.

When the second state has been detected by the second detection processing unit 51A, the display processing unit 54B displays the release operation screen, which is used for the release operation of the regulation on the attachment/removal of the toner container 316 by the lock mechanism 318, on the operation display 6 according to the user's operation in the operation display 6.

For example, the display processing unit 54B causes the release operation screen, which includes the message indicative of the remnant of toner in the toner container 316 mounted to the mounting portion 317, to be displayed.

Second Attachment/Removal Deregulation Process

Figure 8:
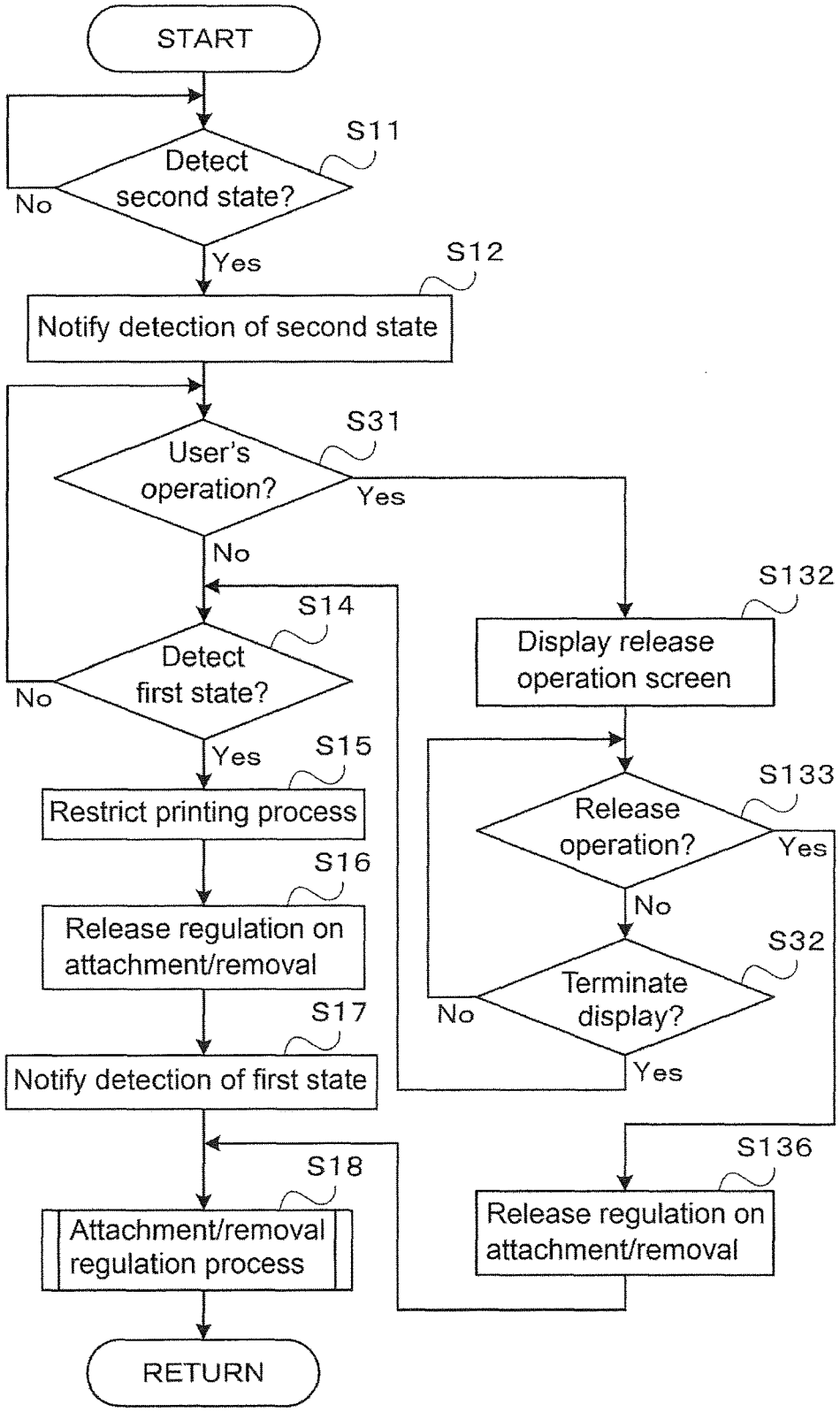
FIG. 8 illustrates one example of a second attachment/removal deregulation process executed by an image forming apparatus according to a second embodiment of the disclosure.

The following describes one example of a procedure for the second attachment/removal deregulation process executed by the control unit 5 in the image forming apparatus 10 according to the second embodiment of the disclosure with reference to FIG. 8. The second attachment/removal deregulation process executes processes at Step S31 and Step S32 instead of the processes at Step S13 and Step S134 in the first attachment/removal deregulation process. The second attachment/removal deregulation process omits the processes at Step S131 and Step S135 in the first attachment/removal deregulation process.

Step S31

At Step S31, the control unit 5 determines whether the user's operation to instruct the display of the release operation screen on the operation display 6 has been executed.

When determining that the user's operation to instruct the display of the release operation screen on the operation display 6 has been executed (Yes at Step S31), the control unit 5 transitions the process to Step S132. When the user's operation to instruct the display of the release operation screen on the operation display 6 has not been executed (No at Step S31), the control unit 5 transitions the process to Step S14.

Step S32

At Step S32, the control unit 5 determines whether the user's operation to instruct a termination of the display of the release operation screen on the operation display 6 has been executed.

When determining that the user's operation to instruct the termination of the display of the release operation screen on the operation display 6 has been executed (Yes at Step S32), the control unit 5 transitions the process to Step S14. When the user's operation to instruct the termination of the display of the release operation screen on the operation display 6 has not been executed (No at Step S32), the control unit 5 transitions the process to Step S133 and waits for the release operation of the regulation on the attachment/removal of the toner container 316 in the release operation screen or the user's operation to instruct the termination of the display of the release operation screen.

Thus, when the second state is detected, the image forming apparatus 10 according to the second embodiment displays the release operation screen according to the user's operation to instruct the display of the release operation screen on the operation display 6. Therefore, similar to the image forming apparatus 10 according to the first embodiment, the image forming apparatus 10 according to the second embodiment can reduce the remaining amount of the toner in the toner container 316 during exchange and can exchange the toner container 316 before the detection of the first state.

Third Embodiment

Figure 9:
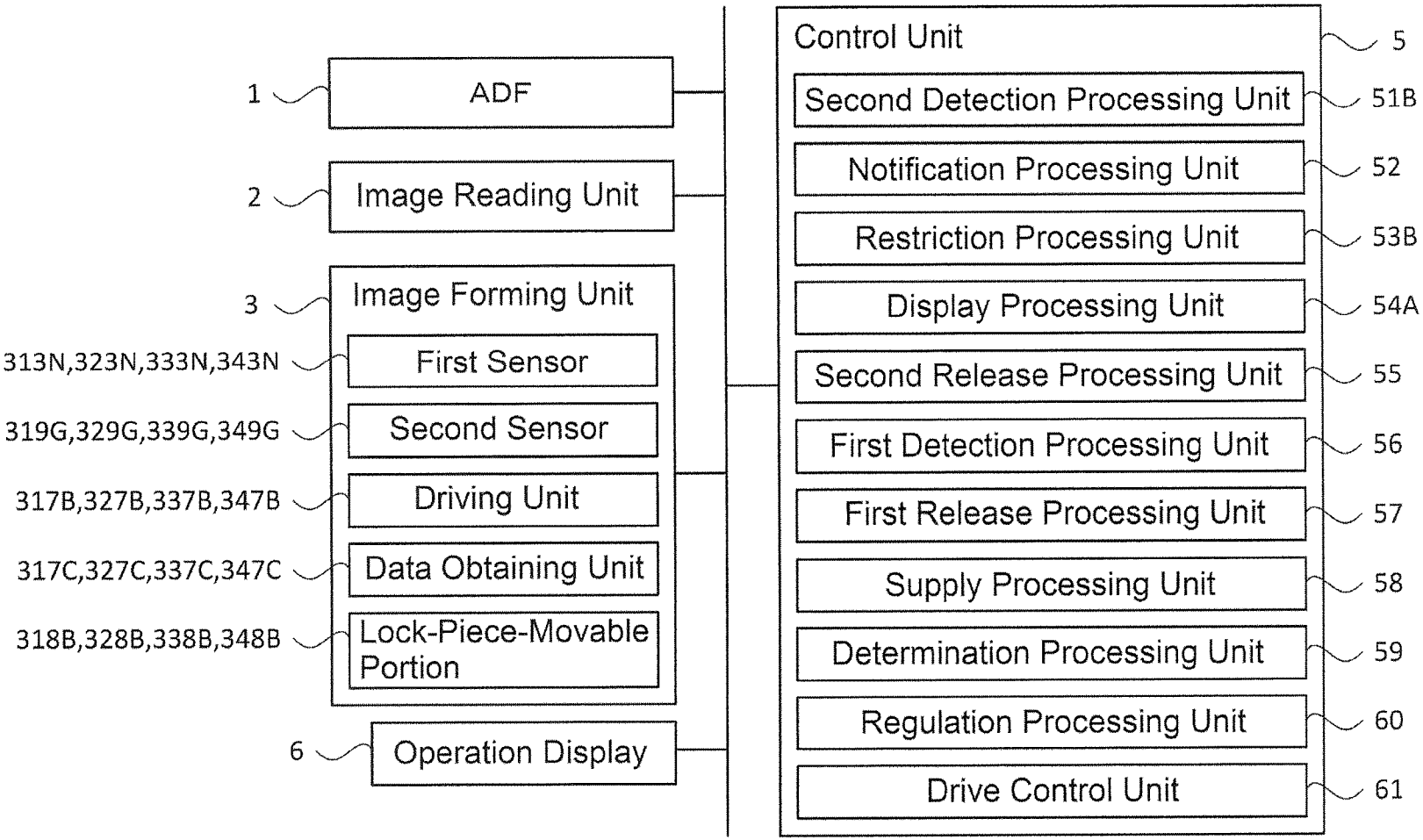
FIG. 9 is a block diagram illustrating a system configuration of an image forming apparatus according to a third embodiment of the disclosure.
Figure 10:
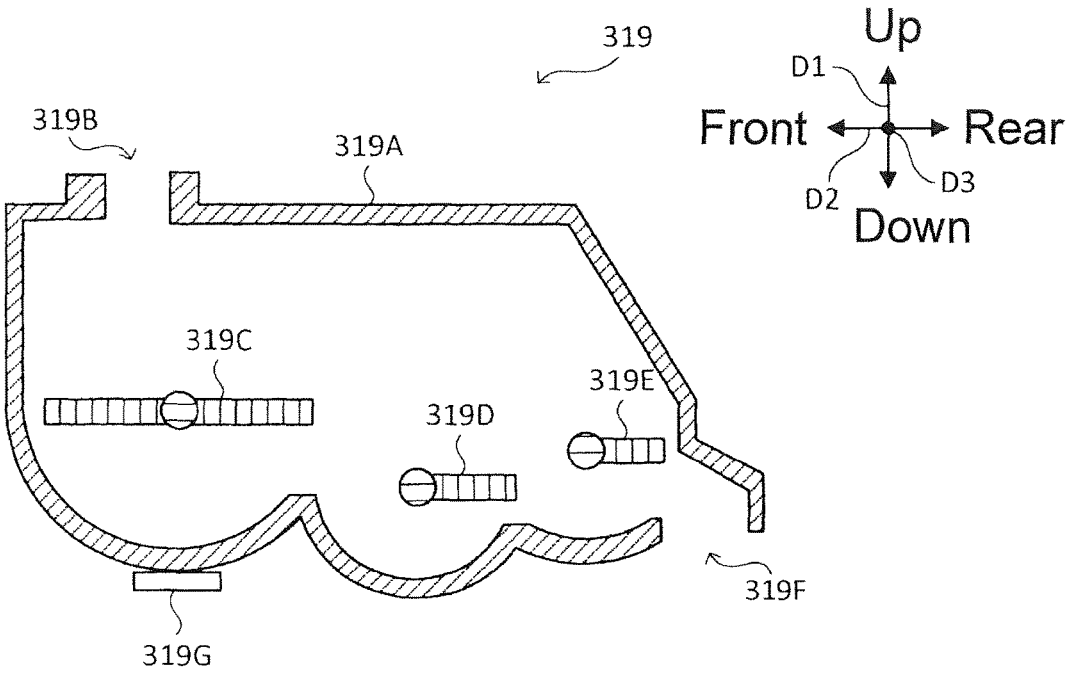
FIG. 10 illustrates a configuration of an intermediate hopper of the image forming apparatus according to the third embodiment.

The following describes the image forming apparatus 10 according to the third embodiment of the disclosure with reference to FIGS. 9 and 10. FIG. 10 schematically illustrates a cross section illustrating a configuration of an intermediate hopper 319.

The third embodiment differs from the above-described first embodiment in some configurations of the image forming unit 3 and the control unit 5. The other configurations are common between the third embodiment and the above-described first embodiment. Accordingly, in the following description, like reference numerals designate identical elements throughout the above-described first embodiment and the third embodiment, and therefore the detailed explanation will not be further elaborated here.

Specifically, the electrophotographic process unit 31 of the image forming apparatus 10 according to the third embodiment includes the intermediate hopper 319 illustrated in FIG. 10. The image forming units 32 to 34 also have the configuration similar to the intermediate hopper 319. The intermediate hopper 319 is one example of an intermediate housing portion of the disclosure.

The intermediate hopper 319 houses the toner supplied from the toner container 316 and supplies the toner to the developing unit 313. That is, with the image forming apparatus 10 according to the third embodiment, the developing unit 313 develops the electrostatic latent image formed on the photoreceptor drum 311 using the toner supplied from the intermediate hopper 319. As illustrated in FIG. 10, the intermediate hopper 319 includes a housing 319A, a first opening 319B, mixing members 319C to 319E, a second opening 319F, and a second sensor 319G.

The housing 319A houses the mixing members 319C to 319E and also houses the toner supplied from the toner container 316. The first opening 319B is connected to the toner container 316 mounted to the mounting portion 317 and is used to carry in the toner supplied from the toner container 316 to the housing 319A. The mixing members 319C to 319E convey and mix the toner housed in the housing 319A. The second opening 319F is connected to the opening 313M on the developing unit 313 to carry out the toner to the first conveyance path 313H of the developing unit 313.

The second sensor 319G detects the remaining amount of the toner housed in the intermediate hopper 319. For example, as illustrated in FIG. 10, the second sensor 319G is located on a bottom portion of the housing 319A. For example, the second sensor 319G is the permeability sensor including the LC oscillation circuit that outputs the electric signals according to the magnetic permeability of the toner housed in the housing 319A. The second sensor 319G is one example of a second developer detecting unit of the disclosure.

In the third embodiment, the ROM in the control unit 5 preliminary stores a third attachment/removal deregulation program to cause the CPU to execute a third attachment/removal deregulation process (see the flowchart in FIG. 11), which will be described later, and the attachment/removal regulation process (see the flowchart in FIG. 7). As illustrated in FIG. 9, the control unit 5 includes a second detection processing unit 51B, the notification processing unit 52, a restriction processing unit 53B, the display processing unit 54A, the second release processing unit 55, the first detection processing unit 56, the first release processing unit 57, the supply processing unit 58, the determination processing unit 59, the regulation processing unit 60, and a drive control unit 61.

The second detection processing unit 51B detects the second state, which is the state where the remaining amount of the toner housed in the toner container 316 mounted to the mounting portion 317 is equal to or more than the first reference amount and less than the predetermined second reference amount larger than the first reference amount.

Specifically, the second detection processing unit 51B detects the second state of the toner container 316 based on the remaining amount of the toner in the intermediate hopper 319 obtained by the second sensor 319G. For example, the second detection processing unit 51B detects the second state based on the increase rate of the remaining amount of the toner in the intermediate hopper 319 obtained by the second sensor 319G when the toner is supplied from the toner container 316 to the intermediate hopper 319 while the printing process is in execution.

When the door opening of the housing cover 10A is detected before the detection of the second state by the second detection processing unit 51B, the restriction processing unit 53B restricts the execution of the printing process. When the door opening of the housing cover 10A is detected after the detection of the second state by the second detection processing unit 51B, the restriction processing unit 53B does not restrict the execution of the printing process.

When the door opening of the housing cover 10A is detected after the detection of the second state by the second detection processing unit 51B, the drive control unit 61 restricts the supply of driving power by the driving unit 317B.

For example, when the door opening of the housing cover 10A is detected while the driving power is supplied from the driving unit 317B to the conveying member of the toner container 316, the drive control unit 61 stops the driving unit 317B. When the door opening of the housing cover 10A is detected while the driving power is not supplied from the driving unit 317B to the conveying member of the toner container 316, the drive control unit 61 inhibits the driving of the driving unit 317B.

Third Attachment/Removal Deregulation Process

Figure 11:
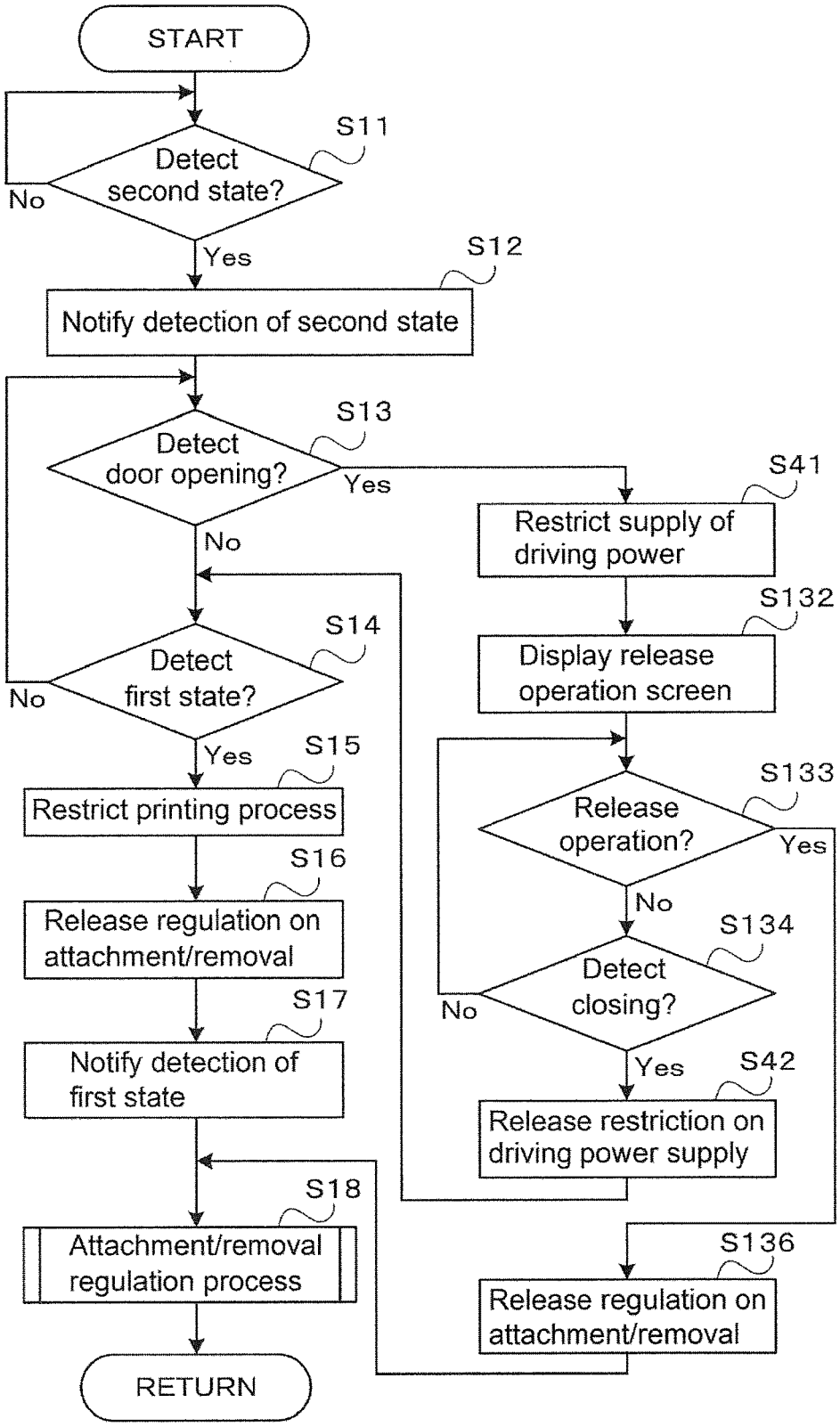
FIG. 11 illustrates one example of a third attachment/removal deregulation process executed by the image forming apparatus according to the third embodiment.

The following describes one example of a procedure for the third attachment/removal deregulation process executed by the control unit 5 in the image forming apparatus 10 according to the third embodiment of the disclosure with reference to FIG. 11. The third attachment/removal deregulation process executes processes at Step S41 and Step S42 instead of the processes at Step S131 and Step S135 in the first attachment/removal deregulation process.

Step S41

At Step S41, the control unit 5 restricts supplying the driving power by the driving unit 317B. Here, the drive control unit 61 in the control unit 5 executes the process at Step S41.

For example, when the door opening of the housing cover 10A is detected while the driving power is supplied from the driving unit 317B to the conveying member of the toner container 316, the control unit 5 stops the driving of the driving unit 317B. When the door opening of the housing cover 10A is detected while the driving power is not supplied from the driving unit 317B to the conveying member of the toner container 316, the control unit 5 inhibits the driving of the driving unit 317B.

Step S42

At Step S42, the control unit 5 releases the restriction on the supply of the driving power by the driving unit 317B at Step S41.

Thus, with the image forming apparatus 10 according to the third embodiment, when the door opening of the housing cover 10A is detected with the second state detected, the supply of the driving power by the driving unit 317B is restricted instead of no restriction on the execution of the printing process. Therefore, even when the printing process is in execution while the door opening of the housing cover 10A is detected with the second state detected, the toner container 316 can be exchanged without halting the printing process.

With the image forming apparatus 10 according to the third embodiment, the toner can be supplied from the intermediate hopper 319 to the developing unit 313 even while the supply of the driving power by the driving unit 317B is restricted. Therefore, when the toner container 316 is exchanged during the execution of the printing process, the image forming apparatus 10 can reduce the reduction in print density of the printed matter output during the exchange work.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

a mounting portion to which a developer housing portion to house developer is mounted;

a lock mechanism configured to regulate attachment/removal of the developer housing portion mounted to the mounting portion;

an image forming unit that forms an image using the developer;

a first detection processing unit that detects a first state, the first state being a state where a remaining amount of the developer housed in the developer housing portion mounted to the mounting portion is less than a predetermined first reference amount;

a second detection processing unit that detects a second state, the second state being a state where the remaining amount of the developer housed in the developer housing portion mounted to the mounting portion is equal to or more than the first reference amount and less than a predetermined second reference amount, the second reference amount being larger than the first reference amount;

a first release processing unit that releases the regulation on the attachment/removal of the developer housing portion by the lock mechanism when the first detection processing unit detects the first state; and a second release processing unit that releases the regulation on the attachment/removal of the developer housing portion by the lock mechanism when the second detection processing unit detects the second state and a predetermined release condition is met.

2. The image forming apparatus according to claim 1, further comprising a display processing unit that causes a display to display a release operation screen when the second detection processing unit detects the second state while a door opening of a cover member is detected, the cover member being opened and closed to attach and remove the developer housing portion, the release operation screen being used for a release operation of the regulation on the attachment/removal of the developer housing portion by the lock mechanism, wherein the release condition includes an execution of the release operation in the release operation screen.

3. The image forming apparatus according to claim 1, further comprising a display processing unit that causes a display to display a release operation screen when the second detection processing unit detects the second state according to a user's operation in an operation unit, the release operation screen being used for a release operation of the regulation on the attachment/removal of the developer housing portion by the lock mechanism, wherein the release condition includes an execution of the release operation in the release operation screen.

4. The image forming apparatus according to claim 2, wherein the display processing unit causes the display to display the release operation screen, the release operation screen including a message indicative of a remnant of the developer in the developer housing portion mounted to the mounting portion.

5. The image forming apparatus according to claim 1, further comprising a notification processing unit configured such that if the second state has been detected by the second detection processing unit, the notification processing unit notifies the detection.

6. The image forming apparatus according to claim 1, wherein the image forming unit includes:

an intermediate housing portion that houses the developer supplied from the developer housing portion;

a developing unit that develops an electrostatic latent image formed on an image carrier using the developer supplied from the intermediate housing portion;

a first developer detecting unit that detects the remaining amount of the developer in the developing unit; and a second developer detecting unit that detects a remaining amount of the developer in the intermediate housing portion, the first detection processing unit detects the first state using the first developer detecting unit, and the second detection processing unit detects the second state using the second developer detecting unit.

7. The image forming apparatus according to claim 1, further comprising:

a connecting portion that engages the developer housing portion mounted to the mounting portion;

a driving unit that supplies a driving power to the developer housing portion mounted to the mounting portion via the connecting portion;

a restriction processing unit that restricts an execution of a printing process when a door opening of a cover member is detected before the detection of the second state by the second detection processing unit, the cover member being opened and closed to attach and remove the developer housing portion, the restriction processing unit not restricting the execution of the printing process when the door opening of the cover member is detected after the detection of the second state by the second detection processing unit; and a drive control unit that restricts the supply of the driving power by the driving unit when the door opening of the cover member is detected after the detection of the second state by the second detection processing unit.

8. A method of releasing a regulation on attachment/removal of a developer housing portion executed by an image forming apparatus, the image forming apparatus including a mounting portion to which the developer housing portion to house developer is mounted, a lock mechanism configured to regulate attachment/removal of the developer housing portion mounted to the mounting portion, an image forming unit that forms an image using the developer, the method comprising:

detecting a first state as a state where a remaining amount of the developer housed in the developer housing portion mounted to the mounting portion is less than a predetermined first reference amount;

detecting a second state as a state where the remaining amount of the developer housed in the developer housing portion mounted to the mounting portion is equal to or more than the first reference amount and less than a predetermined second reference amount, the second reference amount being larger than the first reference amount;

releasing the regulation on the attachment/removal of the developer housing portion by the lock mechanism when the detecting the first state detects the first state; and releasing the regulation on the attachment/removal of the developer housing portion by the lock mechanism when the detecting the second state detects the second state and a predetermined release condition is met.

* * * * *